US007975576B2

(12) United States Patent
Eggert et al.

(10) Patent No.: US 7,975,576 B2
(45) Date of Patent: Jul. 12, 2011

(54) LOW CLEARANCE SOCKET AND DRIVE SYSTEM

(75) Inventors: Daniel M. Eggert, Kenosha, WI (US); Dean J. Iwinski, Muskegon, WI (US); Michael L. Foster, Kenosha, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 2 days.

(21) Appl. No.: 10/508,281

(22) PCT Filed: Mar. 21, 2003

(86) PCT No.: PCT/US03/08876

§ 371 (c)(1),
(2), (4) Date: Mar. 11, 2005

(87) PCT Pub. No.: WO03/082525

PCT Pub. Date: Oct. 9, 2003

(65) Prior Publication Data

US 2005/0160886 A1 Jul. 28, 2005

Related U.S. Application Data

(60) Provisional application No. 60/366,895, filed on Mar. 22, 2002.

(51) Int. Cl.
*B25B 23/16* (2006.01)
*B25B 13/06* (2006.01)

(52) U.S. Cl. ..... 81/177.85; 81/177.2; 81/121.1

(58) Field of Classification Search ..... 81/177.85, 81/177.2, 177.1, 59.1, 60, 63, 63.2, 905, 81/22, 30, 121.1, 61, 62; 279/905, 22, 30; 409/232, 234; 408/239 R, 239
See application file for complete search history.

(56) References Cited

U.S. PATENT DOCUMENTS

| | | | | | |
|---|---|---|---|---|---|
| 2,803,980 | A | * | 8/1957 | Vogel | 81/62 |
| 3,466,953 | A | * | 9/1969 | Gegg | 81/58.3 |
| 4,322,190 | A | * | 3/1982 | Anderson | 409/234 |
| 4,339,094 | A | * | 7/1982 | Thievessen et al. | 242/571.7 |
| 4,475,420 | A | * | 10/1984 | Atkinson et al. | 81/58.3 |
| 4,520,697 | A | * | 6/1985 | Moetteli | 81/62 |
| 4,561,329 | A | * | 12/1985 | Lack | 81/62 |
| 4,602,534 | A | * | 7/1986 | Moetteli | 81/177.85 |
| 4,722,252 | A | * | 2/1988 | Fulcher et al. | 81/57.39 |
| 4,883,255 | A | | 11/1989 | Bacon | |
| 4,939,961 | A | * | 7/1990 | Lee | 81/60 |
| 5,058,463 | A | * | 10/1991 | Wannop | 81/57.29 |
| 5,292,213 | A | * | 3/1994 | Massa et al. | 409/234 |

(Continued)

FOREIGN PATENT DOCUMENTS

DE 195 23 100 A1 1/1997

(Continued)

*Primary Examiner* — David B Thomas
(74) *Attorney, Agent, or Firm* — Seyfarth Shaw LLP

(57) ABSTRACT

A low clearance drive system includes a low clearance socket and/or a low clearance male driver (50). The socket has a reduced depth drive receptacle and a reduced-depth output fastener receiving receptacle. Each of the male driver and the socket drive receptacle has an axial length (L3) or depth which is less than its nominal transverse width (w). The male driver may have a detent ball (55) adapted to be engaged in a detent recess in the female drive receptacle, such that the ball diameter is less than half the nominal transverse drive width and may be either equal to or less than the diameter of the detent recess.

20 Claims, 4 Drawing Sheets

U.S. PATENT DOCUMENTS 5,365,807 A * 11/1994 Darrah et al. ..... 81/60
5,429,018 A * 7/1995 Miller ..... 81/186
5,433,548 A 7/1995 Roberts et al.
5,509,333 A * 4/1996 Rion ..... 81/180.1
5,582,080 A 12/1996 Barmore
5,647,252 A * 7/1997 Miner ..... 81/62
5,738,192 A * 4/1998 Miner ..... 192/43.1
5,848,561 A 12/1998 Hsieh
5,857,390 A * 1/1999 Whiteford ..... 81/62
5,901,620 A * 5/1999 Arnold ..... 81/63.2
6,006,631 A 12/1999 Miner et al.
6,101,902 A * 8/2000 Wei ..... 81/63
6,145,416 A * 11/2000 Bonniot ..... 81/177.75
6,158,308 A * 12/2000 Huang ..... 81/58.3
6,164,166 A * 12/2000 Whiteford ..... 81/63.1
6,332,382 B1 * 12/2001 Anderson et al. ..... 81/438
6,354,176 B1 3/2002 Nordlin
6,510,765 B2 * 1/2003 Mu-Lin ..... 81/63.2
6,536,310 B2 * 3/2003 Goldfein ..... 81/57.29
6,558,402 B1 * 5/2003 Chelak et al. ..... 606/182
6,647,830 B2 11/2003 Marquardt
6,666,112 B2 * 12/2003 Hu ..... 81/63.1
6,739,221 B2 * 5/2004 Cha ..... 81/57.13
6,803,980 B2 * 10/2004 Funahata et al. ..... 349/113
6,832,531 B1 * 12/2004 Marquardt ..... 81/57.3
6,874,392 B1 * 4/2005 Wu ..... 81/177.85
2002/0189409 A1 * 12/2002 Lee ..... 81/177.85
2003/0126957 A1 * 7/2003 Huang ..... 81/60
2004/0089106 A1 * 5/2004 Wolfe et al. ..... 81/58.3
2004/0118252 A1 * 6/2004 Wexler ..... 81/57.29

FOREIGN PATENT DOCUMENTS

DE 201 20 538 U1 3/2002
WO WO 90/02634 3/1990

* cited by examiner

LOW CLEARANCE SOCKET AND DRIVE SYSTEM

RELATED APPLICATION

This application claims the benefit of the filing date of provisional application Ser. No. 60/366,895, filed Mar. 22, 2002 and entitled "Low Clearance Socket and Drive System."

BACKGROUND

This application relates to tools for driving threaded fasteners and the like and, in particular, to sockets and associated driving tools such as ratchet wrenches, breaker bars and the like.

Typically, fastener driving sockets have a driving end with a driver receptacle, typically square in transverse cross section, and a driven output end with a fastener-receiving receptacle, which may have any of a number of polygonal shapes, such as square, hex, double hex and the like. Typically, sockets are provided in sets with different sizes for respectively driving different-sized fasteners. Socket sizes vary with the size of the fastener to be driven. Typically, both the length and the diameter of a socket will change, as will the depth of the fastener-receiving and driver-receiving receptacles, in order to provide adequate strength. Certain of these dimensions are standardized by industry standards-setting organizations.

In certain applications it has become desirable to utilize somewhat shortened sockets to provide additional clearance in tight work spaces. Heretofore, this has been accomplished by shortening the depth of the fastener-receiving receptacle. This has been relatively easy to accomplish, since, typically, the standard fastener-receiving receptacle depth is substantially greater than the axial thickness or height of the standard fastener for which it is sized, in order to allow clearance space, such as when driving a nut onto a stud or bolt. But the shortening which can be effected in this manner necessarily reduces the available clearance space.

SUMMARY

This application describes a system for providing low-profile socket and associated drive systems which avoid the disadvantages of prior systems while affording additional structural and operating advantages.

An aspect of the system described is that it provides significantly lower profile sockets than have heretofore been possible with a conventional internal square drive configuration.

In connection with the foregoing aspect, a further aspect is the provision of a socket with a reduced-depth driver receptacle.

A further aspect is the provision of a socket drive system which provides lowering of the profile of both the socket and the associated male driver.

A still further aspect is the provision of a system of the type set forth, which provides increased torque strength as compared to standard-length socket drive systems.

Yet another aspect is the provision of a low-profile socket driver which is useable with standard-length sockets.

A still additional aspect is the provision of a low-profile socket which has a reduced-depth drive receptacle which is still useable with standard-length drivers.

Certain ones of these and additional aspects may be attained by providing a tool driver comprising a body having a drive portion defining drive surfaces, the drive portion having a central axis and a nominal width measured transverse to the axis, each drive surface having first and second ends spaced apart axially by a drive length which is less than the nominal width.

Further aspects may be attained by providing a tool driver of the type set forth, wherein the drive portion has an arcuate detent portion extending from a drive surface in a direction substantially perpendicular to the central axis, the detent portion having a diameter less than one-half the nominal width.

Still further aspects may be attained by providing a male tool driver adapted to be received in an associated drive receptacle which has formed in an inner surface thereof an arcuate detent recess having a first diameter, the male tool driver comprising a drive body shaped and dimensioned to be mateably received in an associated drive receptacle and having a detent cavity formed laterally in a side thereof, a detent ball captured in the cavity and resiliently urged to a rest position projecting laterally therefrom for engagement in the detent recess when the drive body is disposed in the receptacle, the ball having a second diameter substantially less than the first diameter.

Additional aspects may be attained by providing a tool drive system comprising a female drive body having a drive receptacle formed therein with a central axis, the receptacle having an axial depth and a nominal width measured transverse to the axis; and a male drive body having a drive portion with an axial length drive and shaped and dimensioned to be mateably received in the receptacle, each of the axial depth and the drive length being less than the nominal width.

Still further aspects may be attained by providing a method of reducing the overall length of a drive system which includes a female driver with a drive receptacle having a drive axis and an arcuate detent recess in a side wall thereof, and a male driver shaped and dimensioned to be mateably received in the receptacle and having a detent ball projecting from a side thereof, the method comprising reducing the diameter of the ball and correspondingly reducing the axial length of the male driver, and so positioning the reduced-diameter ball on the male driver that it will engage in the detent recess when the male driver is received in the receptacle.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
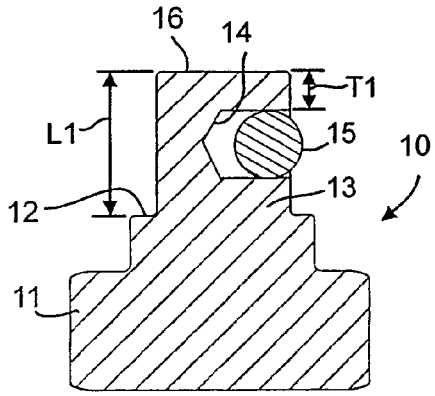
FIG. 1 (PRIOR ART)
FIG. 1 is a sectional view of a prior-art ratchet gear with a standard-length drive square.

Referring to FIG. 1, there is illustrated a male tool driver in the form of a standard-length drive head for use with standard-length sockets. The drive head is generally designated by the numeral 10 and has a base 11 which may, for example, be a ratchet gear of a ratchet wrench, a reduced-diameter shoulder 12 and a drive lug 13, which is typically square in transverse cross section and will hereinafter be referred to as a "drive square." Formed in one side of the drive square 13 is a cylindrical cavity 14 receiving a detent portion in the form of a detent ball 15, which is trapped in the cavity 14 and is biased outwardly by a helical compression spring (not shown), all in a known manner. The drive square 13 has an end surface 16 spaced from the cavity 14 by a predetermined distance T1 and from the shoulder 12 by a predetermined distance L1 which defines the axial drive length of the drive square 13. The size of the detent ball 15 is standard for a particular size drive square. The drive square may come in a variety of standard sizes, such as ¼", ⅜" and ½", with the ball size increasing with the size of the square.

Figure 2:
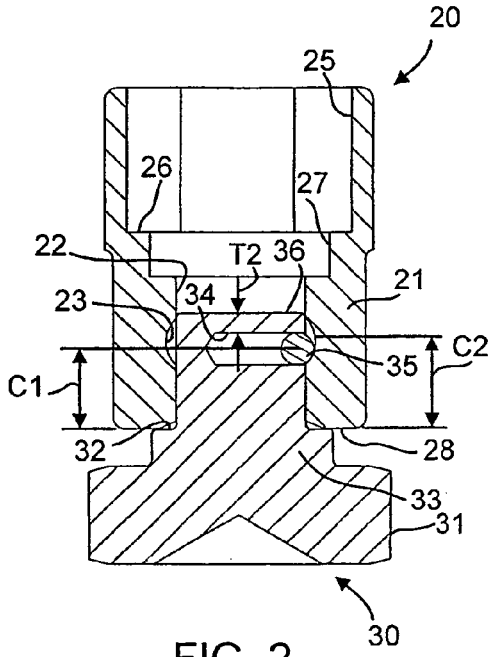
FIG. 2 is a sectional view of a ratchet gear with a low-profile drive square engaged with a prior-art socket with a reduced-depth fastener-receiving receptacle.

The drive square 13 is adapted to be used with an associated standard-length socket (not shown). However, there is illustrated in FIG. 2 a prior-art reduced length female tool driver or socket, designated by the numeral 20, which is similar to a standard-length socket except in the manner to be described below. The socket 20 has a generally cylindrical body 21 with a driver-receiving receptacle 22 in one end surface 28 thereof dimensioned and shaped to match the associated driver. In this case, the receptacle is square in transverse cross section and is sized to match the drive square 13 which, in the illustrated embodiment is a ⅜" driver. Respectively formed in the side walls of the receptacle 22 are detent portions in the form of detent recesses 23 sized and positioned to receive the ball 15 and retain the socket 20 in place on the drive square 13. Formed in the other end of the socket 20 is a fastener-receiving receptacle 25, which terminates at a shoulder 26. In this case, there is a further recess 27 in the shoulder 26 which defines a central cylindrical bore which communicates with the receptacle 22, but it will be appreciated that there could also be a web of material separating the receptacles 22 and 25. The only difference between the socket 20 and a standard-length socket for a ⅜" drive system is that the fastener-receiving receptacle 25 is of a slightly shallower depth than would normally be the case, to provide a slightly lower profile.

Figure 3:
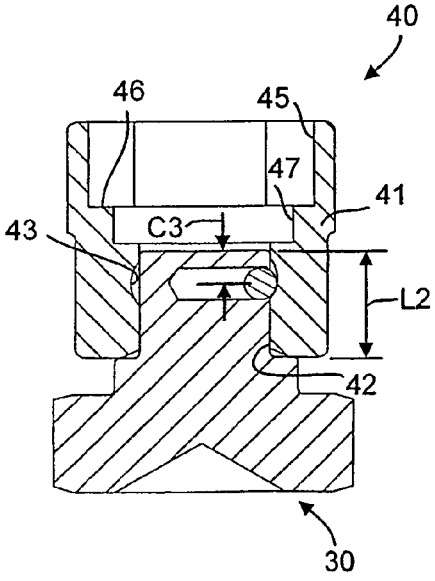
FIG. 3 is a view similar to FIG. 2 with a low-profile socket having reduced-depth fastener-receiving and driver-receiving receptacles.
Figure 5:
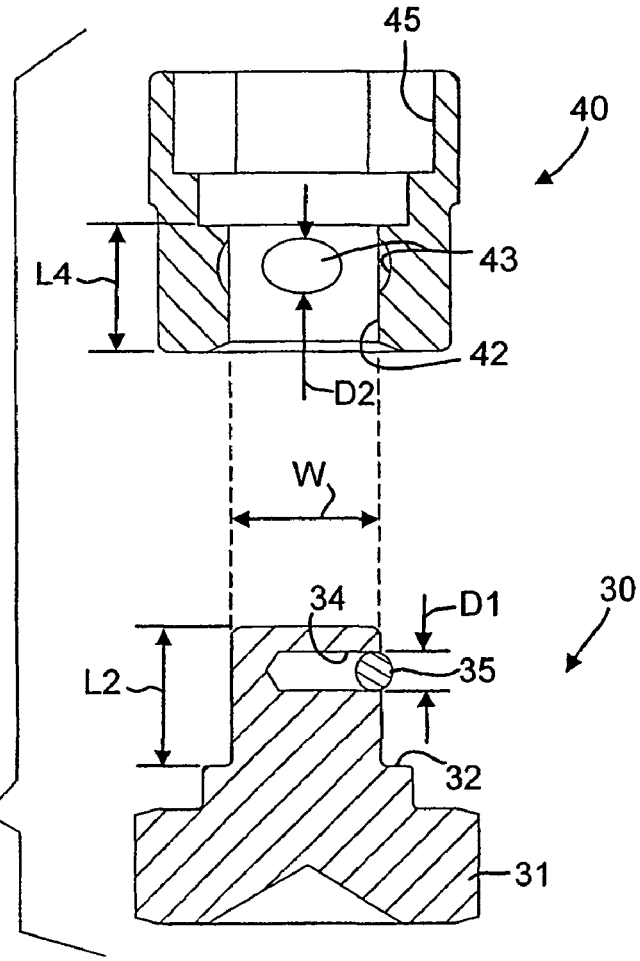
FIG. 5 is a view similar to FIG. 3, showing the parts separated.

Also illustrated in FIG. 2, as well as in FIGS. 3 and 5, is a low-clearance or low-profile drive head 30 having a base 31, a shoulder 32 and a low-profile drive square 33. Formed in one side of the drive square 33 is a cylindrical cavity 34 receiving a detent ball 35, which is biased outwardly by a helical compression spring (not shown). The drive square 33 has an end surface 36 spaced from the cavity 34 by a predetermined distance T2. It is significant that, while the standard-length drive square 13 has an overall length L1 from the shoulder 12 to the end surface 16, the low-profile drive square 33 has an overall length L2 (see FIG. 3) from the shoulder 32 to the end surface 36 which is substantially less than the length L1. In the illustrated embodiment, the ratio L2/L1 is about 0.73 on average, but this ratio could vary. For example, since at least the L1 dimension is based on existing standards for standard-length drive squares, it could change if the standards change. Furthermore, it could change with the method of retaining the socket on the drive square. In the illustrated embodiments, this retention is by means of a detent ball engaging in associated detent recesses, but it will be appreciated that other retention means could be used, such as an O-ring attached to the very end of the square (as opposed to being retained in a groove) by means of a screw or a shouldered pin engaged axially in the end surface of the drive square.

This reduced length L2 allows for adequate wall thickness between the end surface 36 of the drive square and the ball cavity 34, so that the ball location on the square can remain close to the current standard dimension. The wall thickness T2 allows the embossing tool to move material completely around the ball and not push the material at the end surface 36 of the drive square outward away from the ball.

If, alternatively, an annular ring seated in a groove were to be used for retention instead of a ball and spring, this ratio provides adequate length to ensure that the ring will be retained in its associated groove. This ratio also locates the ball 35, which is about 50% of the standard size ball, to engage the standard detent recess toward the driver end of the socket.

It has been found that this length reduction can be effected without adversely affecting the strength of the drive square 33 and this is effected principally by utilizing a detent ball 35 which has a diameter approximately one-half that of the detent ball 15. Accordingly, the distance T2 that the recess 34 is spaced from the end surface 36 may be substantially less than the corresponding distance T1 of the drive square 13.

The distance from the shoulder 32 to the center line of the ball 35 (dimension C1 in FIG. 2) is slightly less than the distance C2 from the end surface 28 to the center line of the detent recesses 23 of the socket 20, so that when the socket 20 bottoms on the shoulder 32 the ball 35 will engage the detent recess 23 in the lower half of the recess. This permits the low-profile drive head 30 to be used with standard sockets, while still providing effective retention.

A significant aspect is that the drive length L2 of the drive square 33 is less than the nominal width W (FIG. 5) of the drive square 33 as measured transversely of the axis X between opposed flats or drive surfaces of the drive square 33. Another significant aspect is that the diameter D1 of the detent ball 35 (and, therefore, the diameter of the cylindrical cavity 34) is less than one-half the nominal width W. These relationships hold true for all nominal widths or sizes of the drive square 33, e.g., one-quarter inch, three-eighths inch, one-half inch, etc. Also, the diameter D1 of the ball 35 is less than the diameter D2 of the detent recess 23 in a standard socket 20 nominally sized to mate with the drive square 33, which relationship also holds true for all nominal sizes of the drive square 33.

Referring to FIGS. 3 and 5, there is illustrated a low-clearance or low-profile socket 40 having a generally cylindrical body 41 with a driver-receiving receptacle 42 in one end thereof dimensioned and shaped to mateably receive an associated drive head. In this case the receptacle 42 is square in transverse cross section and is sized to match the drive square 33. Respectively formed in the side walls of the receptacle 42 are detent recesses 43 sized and positioned to receive either the ball 15 or the ball 35 to retain the socket 40 in place on either the drive square 33 or the drive square 13. Formed in the other end of the socket 40 is a fastener-receiving receptacle 45, which terminates at a shoulder 46. There is a further recess 47 in the shoulder 46 which communicates with the receptacle 42, but it will be appreciated that there could also be a web of material separating the receptacles 42 and 45.

It can be seen that the overall length of the socket 40 is substantially less than that of the socket 20. This is effected by shortening the depths of both of the receptacles 42 and 45. The axial depth L4 of the driver-receiving receptacle 42 may be very slightly greater than the length L2 of the associated low-profile drive square 33, whereas the depth of the fastener-receiving receptacle 45 is less than the maximum hexagon mandrel insertion per ASME B 107.5 m-1994, in this case approximately 85% of that standard. The latter depth is selected so as to minimize the overall length of the socket while still affording adequate engagement with the associated fastener for a wide range of fastener types.

As is apparent from the figures, the axial depth L4 of the driver-receiving receptacle 42 is less than the nominal width of that receptacle, which is very slightly greater than the nominal width W of the male drive square 33 of the same nominal size, for proper mating engagement of the two. Also, the socket 40 may have the same axial distance C2 from the end of the socket to the center of the ball detent recess 43 as in the socket 20, so that the socket 40 may be usable with both standard drive heads (FIG. 1) and low-profile drive heads 30, providing good mating engagement of either the standard ball 15 or the reduced-diameter ball 35 in the detent recess 43.

It will be appreciated that, in the illustrated embodiment, the overall length of the socket 40 could be further reduced by shortening the depth of the recess 47 which communicates with both of the receptacles 42 and 45. In the event that the socket is cold formed, there must be a web of material separating those receptacles, but the thickness of the web could be reduced to the minimum necessary to prevent the opposing punches from engaging each other and damaging the cold forming machinery. Where opposing punches are not used, the recess 47 could be effectively eliminated.

Figure 4:
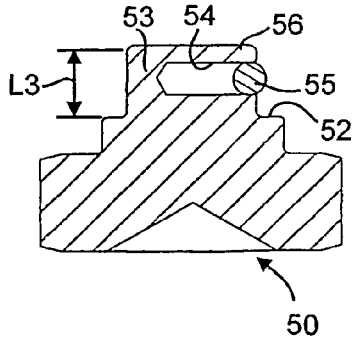
FIG. 4 is a view similar to FIG. 1 showing a minimum-length drive square.

Referring to FIG. 4, there is illustrated a minimum-profile drive head 50, which is substantially the same as the low-profile drive head 30, except that it has a drive square 53 of a still further reduced length L3. This represents the minimum length which would be possible while still meeting required strength standards. This length is limited by the necessary distance between the receptacle 54 and the end surface 56 and the distance between receptacle 54 and the shoulder 52. It will be appreciated that this minimum-profile drive head 50 would have to be used with a customized socket, wherein the detent recesses are positioned to mate with the ball 55, and, accordingly, this drive head could not be used with sockets having standard-depth driver-receiving receptacles, such as the socket 20, wherein the detent recesses are at standard distances from the end of the socket.

Figure 6:
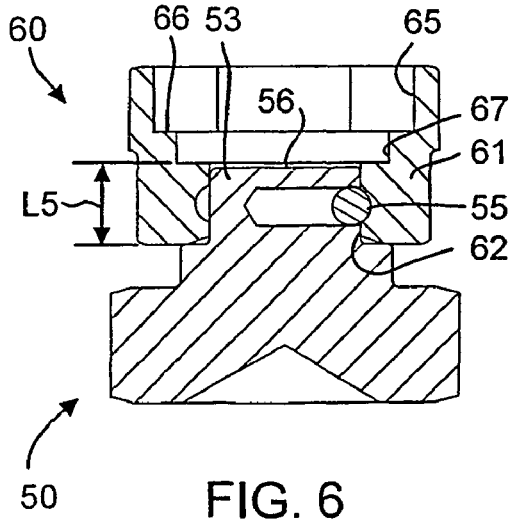
FIG. 6 is a view similar to FIG. 3 showing the drive square of FIG. 4 engaged with an associated minimal profile socket.

Referring now to FIG. 6, there is illustrated a minimum profile socket 60 dimensioned for mating engagement with the minimum profile drive square 53 of FIG. 4. The socket 60 has a generally cylindrical body 61 with a driver-receiving receptacle 62 in one end thereof dimensioned and shaped to mateably receive the drive square 53. Respectively formed in the side walls of the receptacle 62 are detent recesses 63 sized and positioned to mateably receive the detent balls 55 to retain the socket 65 in place on the drive square 53. Formed in the other end of the socket 60 is a fastener-receiving receptacle 65, which terminates at the shoulder 66. There is a further recess 67 in the shoulder 66 which communicates with the receptacle 62, but it will be appreciated that there could also be a web of materials separating the receptacle 62 and 65.

It can be seen that, since the driver-receiving receptacle 62 need only be long enough to accommodate the reduced-length drive square 53, the receptacle 62 has an axial depth L5 which is only very slightly greater than the axial length L3 of the drive square 50 (see FIG. 4). This reduced depth is further accommodated by the fact that the detent recess 63 has a reduced diameter, being only large enough to accommodate the reduced-diameter ball 55. The axial depth of the fastener-receiving receptacle 65 is also further reduced, as compared with the receptacle 45 of the low-profile socket 40.

It will be appreciated that, since the drive length L3 of the drive square 53 and the axial depth L5 of the driver-receiving receptacle 62 are even smaller than the comparable lengths and depths for the drive head 30 and socket 40 of FIG. 3, while the same reduced-diameter detent ball 55 is used and the nominal width W remains the same, it necessarily follows that, for the drive head 50 and the socket 60 the drive square length and the driver-receiving receptacle depth are both less than the nominal width W and the detent ball diameter is less than half the nominal width W.

These relationships are illustrated in Table 1, which sets forth the square drive length, the detent ball diameter and the "Ball Location" (axial distance from ball center to shoulder 12, 32 or 52) for standard (13), low profile (33) and very low profile (53) drive squares for three different nominal drive square sizes or widths (designated "W"). The sizes illustrated are for one-quarter inch, three-eighths inch and one-half inch drives.

TABLE I

| Description | Std | Low Profile | Very L-P |
|---|---|---|---|
| ¼" External (W = .250-.247) | | | |
| Square Dr Length | 0.300 | 0.2135 | 0.143 |
| Ball Diameter | 0.125 | 0.078 | 0.062 |
| Ball Location | 0.150 | 0.140 | 0.085 |
| ⅜" External (W = .375-.372) | | | |
| Square Dr Length | 0.427 | 0.320 | 0.214 |
| Ball Diameter | 0.187 | 0.125 | 0.0935 |
| Ball Location | 0.220 | 0.210 | 0.130 |
| ½" External (W = .500-.497) | | | |
| Square Dr Length | 0.56 | 0.427 | 0.286 |
| Ball Diameter | 0.25 | 0.156 | 0.125 |
| Ball Location | 0.32 | 0.30 | 0.175 |

It can be seen that, for all sizes, the ratio of the axial square drive length to the nominal width is substantially 0.854 for the low profile drive square 33 and is substantially 0.572 for the very low profile drive square 53. In an embodiment, the drive length is in a range of 0.5 times the nominal width to 0.9 times the nominal width, thereby providing the low clearance benefits of the present application. However, for the standard square drive, corresponding to that of FIG. 1, the axial square drive length is always greater than the nominal width. It can also be seen that, whereas in the standard square drive the ball diameter is one-half the nominal width, in the low profile and very low profile drive squares, the ball diameter is substantially less than the corresponding ball diameter for a standard drive square. More specifically, the low profile and very low profile ball diameters are in a range of from about 0.4 times the standard ball diameter to about 0.7 times the standard ball diameter and, in particular, in a range of from about 0.49 to about 0.67 times the standard ball diameter.

It can also be seen from FIGS. 2 and 4, for example, that the axial distance T2 between the end surface of the drive square and the ball receptacle 54 is minimized, leaving just enough material thickness for the annular embossing ring (used to swage the edge of the ball cavity to retain the ball in place) to go completely around the ball and ensure a full circumferential swage. The drive square 53 may not be as strong as the low-profile drive square 33 when tested for ultimate strength, but will still meet applicable standards.

Figure 7A:
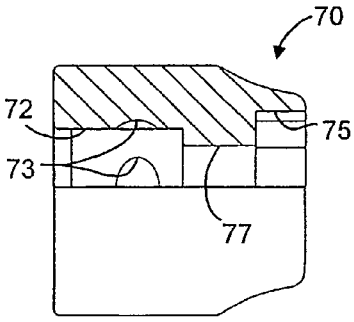
FIG. 7A is a view partially in side elevation and partially in vertical section of a first size of a low-profile socket similar to that shown in FIG. 5.
Figure 7B:
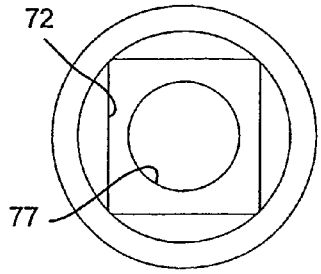
FIGS. 7B and 7C are, respectively, left-side and right-side elevational views of the socket of FIG. 7A.
Figure 7C:
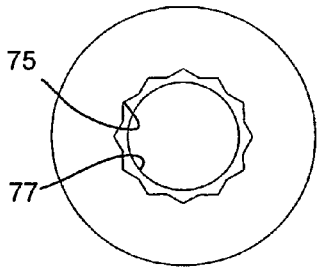
Figure 8A:
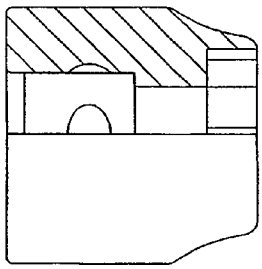
FIG. 8A is a view similar to FIG. 7A of another size of socket.
Figure 8B:
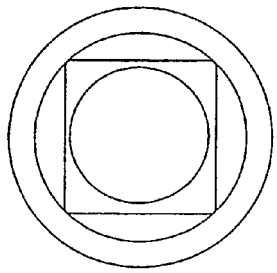
FIGS. 8B and 8C are, respectively, left-side and right-side elevational views of the socket of FIG. 8A.
Figure 8C:
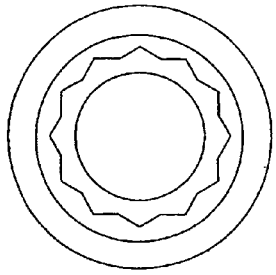
Figure 9A:
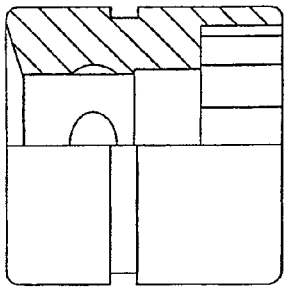
FIG. 9A is a view similar to FIG. 7A of another size of socket.
Figure 9B:
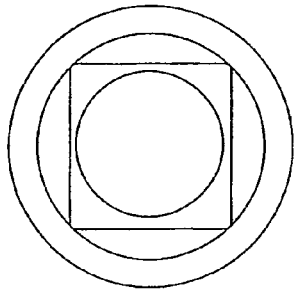
FIGS. 9B and 9C are, respectively, left side and right side elevational views of the socket of FIG. 9A.
Figure 9C:
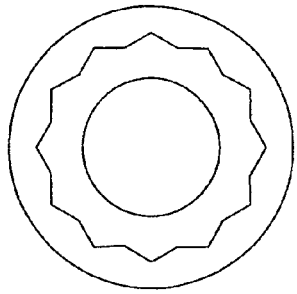
Figure 10A:
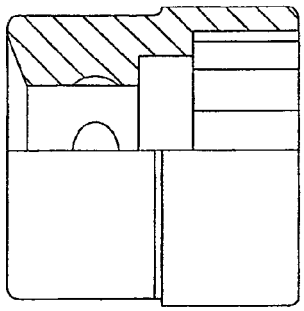
FIG. 10A is a view similar to FIG. 7A of another size of socket.
Figure 10B:
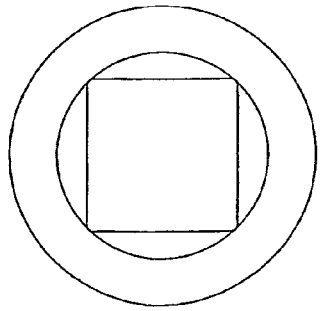
FIGS. 10B and 10C are, respectively, left-side and right-side elevational views of the socket of FIG. 10A.
Figure 10C:
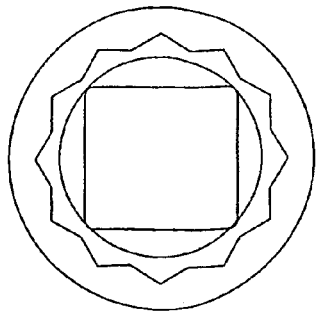

FIGS. 7A-7C illustrate a low-profile, 8 mm socket 70 for use with a ⅜" drive square. The socket 70 is similar to the socket 40, having a driver, receiving receptacle 72, detent recesses 73 and a fastener-receiving receptacle 75, there being a cylindrical aperture or recess 77 providing communication between the receptacles 72 and 75. The driver-receiving receptacle 72 is dimensioned like the receptacle 42 of the socket 40, but the fastener-receiving receptacle 75 of the socket 70 is even shallower than the corresponding receptacle 45 of the socket 40.

FIGS. 8A-10C illustrate low-profile sockets similar to the socket 70, except for use with different fastener sizes, viz., 10 mm, 12 mm and 14 mm. As can be seen from these figures, the external profile of the socket at the fastener-receiving end and the size of the aperture between the receptacles change as the size of the fastener-receiving receptacle increases.

By use of the foregoing techniques, the overall socket length may be reduced by about 40% as compared with standard-length sockets, thereby providing additional clearance in tight work areas without compromising torsional strength. By reducing the length of the drive square and the depth of the driver-receiving receptacle of the socket by about 53% each, as compared with standard lengths and depths, to distances found experimentally to achieve the same torsional strength as the standard-length drive square and standard-depth driver receptacle, additional working clearance is obtained without a reduction in strength.

More importantly, by reducing the depth of the fastener-receiving receptacle of the socket, while still maintaining full engagement with the fastener, increased torsional strength is obtained, at least in smaller-sized sockets, as compared to standard-length sockets when tested with a ratchet handle. In particular, because the ratchet also produces a bending moment load, the shorter the socket, the lower the bending moment. In other words, there is a certain amount of tolerance clearance between the socket and the associated drive square and associated fastener which can permit a slight tilt of the socket axis in use with respect to the axis of the fastener being driven. The longer the overall length of the socket, the greater can be the radial distance from the fastener axis to the socket axis and, therefore, the greater the bending moment and corresponding losses in torque transfer to the fastener. The increased strength obtained by providing a low-profile socket is achieved, while also obtaining additional clearance for working in close quarters. Further, the socket retention on the external drive square is achieved with a reduced-diameter ball and spring so as not to reduce the square strength, while still allowing engagement into a shortened internal square receptacle.

By increasing wall thickness slightly on larger sizes and/or increasing the blend radius at the bottom of the fastener-receiving receptacle, additional torsional strength may be obtained.

The manufacture of the sockets can be accomplished by using existing cold form tooling. Reduction of the distance from the bottom of the driver-receiving receptacle to the bottom of the fastener-receiving receptacle may be effected by simply causing the same cold form tooling to punch deeper in the material.

Table II shows dimensions for the very low profile socket 60, the low-profile socket 40 and a standard ("Std") socket, such as the socket 20, having a standard-depth driver-receiving receptacle corresponding, respectively, to the drive squares of Table I and for the same three drive sizes. In this table, the dimension "Sq Depth" refers to the axial depth of the driver-receiving receptacle (see distance L4 in FIG. 5), the dimension "Recess location" refers to the axial distance from the driving end of the socket to the center line of the detent recesses (dimension C2 in FIG. 2), and the dimension "Recess Size" refers to the diameter of the detent recess (see dimension D2 in FIG. 5). The hex or fastener-receiving receptacle depth for the illustrated sockets is about 85% of the maximum hexagon mandrel insertion per the ASME B107. 5M-1994 standard.

It will be appreciated that the certain socket dimensions will be slightly greater than corresponding drive square dimensions to accommodate mating engagement of the parts. Furthermore, it will be understood that, throughout this application, all dimensions given are targets and are subject to a tolerance range, such as for manufacturing variations.

TABLE II

| Description | Std | Low Profile | Very L-P |
|---|---|---|---|
| ¼" External (Dr = .250-.247) | | | |
| Square Dr Depth | 0.360 | 0.2435 | 0.173 |
| Recess Diameter | 0.125 | 0.078 | 0.062 |
| Recess Location | 0.155 | 0.145 | 0.090 |
| ⅜" External (Drvr = .375-.372) | | | |
| Square Dr Depth | 0.47 | 0.35025 | 0.2445 |
| Recess Diameter | 0.187 | 0.125 | 0.0935 |
| Recess Location | 0.228 | 0.215 | 0.135 |
| ½" External (Drvr = .500-.497) | | | |
| Square Dr Depth | 0.66 | 0.457 | 0.316 |
| Recess Diameter | 0.25 | 0.156 | 0.125 |
| Recess Location | 0.332 | 0.305 | 0.180 |

While particular embodiments have been shown and described, it will be apparent to those skilled in the art that changes and modifications may be made without departing from the principles of the socket and drive system in its broader aspects. The matter set forth in the foregoing description and accompanying drawings is offered by way of illustration only and not as a limitation.

What is claimed is:

1. A low profile driver tool comprising:

a drive lug extending a drive lug length from a shoulder to a distal surface including a plurality of lateral surfaces defining a drive lug cross section adapted to matingly engage a drive receptacle of a standard socket, the drive lug length reduced by a first ratio relative to a corresponding length of a standard drive lug having the drive lug cross section; and a detent member disposed in a detent member cavity extending into one of the lateral surfaces and having a diameter reduced by a second ratio relative to a corresponding diameter of a standard detent member of the standard drive lug, the detent member cavity adapted to align the detent member with a proximal portion of a standard socket detent recess of the standard socket, the detent member cavity having a centerline spaced a centerline distance from the shoulder, the centerline distance being less than a corresponding distance from a standard drive shoulder to a standard centerline of a standard detent cavity of the standard drive lug.

2. The low profile driver tool of claim 1, wherein the centerline distance aligns the detent member with a detent recess of a low profile socket.

3. The low profile driver tool of claim 2, wherein the detent member cavity includes a distal edge disposed a distal edge distance from the distal surface of the drive lug defining a wall thickness between the distal surface and the detent member cavity, the distal edge distance enables a full swage of the detent member cavity.

4. The low profile tool driver of claim 2, further comprising:

a low profile socket adapted to matingly engage the drive lug and including a detent recess having a diameter reduced by the second ratio from a corresponding diameter of the standard socket detent recess of the standard socket.

5. The low profile tool driver of claim 1, wherein the drive lug cross section has a size of ¼ inches and the first ratio is about 0.71.

6. The low profile tool driver of claim 1, wherein the drive lug cross section has a size of ⅜ inches and the first ratio is about 0.75.

7. The low profile tool driver of claim 1, wherein the drive lug cross section has a size of ½ inches and the first ratio is about 0.76.

8. The low profile tool driver of claim 1, wherein the drive lug cross section has a size of ¼ inches and the second ratio is about 0.62.

9. The low profile tool driver of claim 1, wherein the drive lug cross section has a size of ⅜ inches and the second ratio is about 0.67.

10. The low profile tool driver of claim 1, wherein the drive lug cross section has a size of ½ inches and the second ratio is about 0.62.

11. A low profile socket comprising:

a socket body having first and second ends defining a body length therebetween, the body length being less than a corresponding length of a standard socket;

a drive receptacle extending a receptacle depth from the first end into the socket body and including a plurality of first interior lateral surfaces defining a receptacle cross section and adapted to matingly engage a standard drive lug, the receptacle depth reduced by a first ratio relative to a corresponding depth of a standard drive receptacle of the standard socket; and a detent recess having a diameter reduced by a second ratio relative to a corresponding diameter of a standard detent recess of the standard socket, the detent recess extending into one of the first interior lateral surfaces of the drive receptacle, the detent recess having a centerline spaced a centerline distance from the first end, the centerline distance being the same as a corresponding distance from an end of the standard socket to a standard detent recess centerline of the standard socket and adapted to align the detent recess with a standard detent member of the standard drive lug.

12. The low profile socket of claim 11, wherein the centerline distance is adapted to align the detent recess with a detent member of a low profile drive lug.

13. The low profile socket of claim 12, further comprising:

a fastener receiving receptacle extending a fastener depth from the second end into the socket body, the fastener depth being less than a corresponding depth of a standard fastener receiving receptacle of the standard socket, the fastener receiving receptacle including a plurality of second interior lateral surfaces adapted to matingly engage a fastener.

14. The low profile socket of claim 12, further comprising:

a low profile drive lug adapted to matingly engage the drive receptacle, the detent member of the low profile drive lug having a diameter reduced by the second ratio.

15. The low profile socket of claim 11, wherein the receptacle cross section has a size of ¼ inches and the first ratio is about 0.68.

16. The low profile socket of claim 11, wherein the receptacle cross section has a size of ⅜ inches and the first ratio is about 0.75.

17. The low profile socket of claim 11, wherein the receptacle cross section has a size of ½ inches and the first ratio is about 0.69.

18. The low profile socket of claim 11, wherein the receptacle cross section has a size of ¼ inches and the second ratio is about 0.62.

19. The low profile socket of claim 11, wherein the receptacle cross section has a size of ⅜ inches and the second ratio is about 0.67.

20. The low profile socket of claim 11, wherein the receptacle cross section has a size of ½ inches and the second ratio is about 0.62.

* * * * *